United States Patent [19]

Werblin

[11] 3,968,847

[45] July 13, 1976

[54] WELLPOINT JETTING HEAD

[75] Inventor: David A. Werblin, Riverdale, N.Y.

[73] Assignee: Griffin Wellpoint Corporation, New York, N.Y.

[22] Filed: June 26, 1975

[21] Appl. No.: 590,508

[52] U.S. Cl. ..... 175/402; 175/314; 175/318

[51] Int. Cl.[2] ..... E21B 17/14

[58] Field of Search ..... 175/407, 402, 403, 404, 175/405, 417, 314; 61/53.75

[56] References Cited

UNITED STATES PATENTS

| | | | |
|---|---|---|---|
| 443,072 | 12/1890 | Chapman | 175/397 X |
| 982,491 | 1/1911 | Heggem | 175/402 |
| 1,019,357 | 3/1912 | Porter et al. | 175/402 |
| 1,513,083 | 10/1924 | Baker | 175/398 X |
| 2,028,447 | 1/1936 | Griffin | 175/407 |
| 2,196,940 | 4/1940 | Potts | 175/407 |
| 2,827,264 | 3/1958 | Sitton et al. | 175/398 |

*Primary Examiner*—Ernest R. Purser
*Assistant Examiner*—Richard E. Favreau
*Attorney, Agent, or Firm*—William D. Stokes

[57] ABSTRACT

A wellpoint jetting head having a plurality of spade-like teeth annularly positioned around the forward end of the head and projecting longitudinally therefrom for dislodging and chopping of the soil during hydrostatic jetting in combination with a tilting, side-to-side, rotational and/or up-and-down manipulation of the wellpoint. The teeth are beveled in a counterbalancing inward-outward staggered arrangement with the cutting surface formed by the teeth ends defining a cutting plane canted with respect to the longitudinal axis of the head. The teeth are circumferentially spaced providing lateral confronting side faces for dislodging soil particulate during use.

5 Claims, 6 Drawing Figures

WELLPOINT JETTING HEAD

BACKGROUND OF THE INVENTION

1. Field of the Invention

The invention relates to apparatus for draining water bearing stratum, generally known as wellpoints, and more particularly to a jetting head of such a device.

2. Description of the Prior Art

It has been well known for some time in the water collector art to utilize wellpoints which jet the soil by fluid under pressure to continuously flush away detrital material from its situs permitting the point to gradually advance to a depth below the surface for withdrawing water from the soil by a suction operation. Such a device is typified by U.S. Pat. No. 2,028,447, issued to T. G. Griffin and assigned to the same assignee as the present invention which is an improvement over the same.

Several jetting heads have been developed for use in wellpoints, the majority of which are generally conical, ogival or in the shape of surface configurations radially symmetrical about their longitudinal axis and having a flat plane at their tip. Such configurations of jetting heads provide uniform resistance across their surfaces and may be retarded or obstructed during their vertical descent when passing through gravelly, stony, clay-like and organic formations such as bog, peat and meadow mat.

Thus, the invention of a nozzle head that will effectively penetrate through stony soils and chop through clay and organic formations is highly welcomed in the water collector art.

SUMMARY OF THE INVENTION

It is, therefore, an object of this invention to provide a wellpoint nozzle head adapted for effectively cutting through rugged subterranean formations for quickly and easily advancing the wellpoint beneath the surface.

It is also an object of this invention to provide a wellpoint head configuration readily adaptable to existing wellpoint structures.

It is another object to provide a wellpoint digging head for effectively transmitting a vertical digging force impressed thereon.

The objects and purposes of the invention are achieved by a jetting nozzle formed from an elongated hollow body terminating in a cylindrical sleeve portion having a plurality of spade-like teeth projecting to form the perimetrical end of the sleeve with each of the teeth formed by spatially communicating faces cut therefrom. The teeth are circumferentially spaced terminating in arcuately concentric bullnosed or flat surfaces alternating in a radially-spaced relationship with respect to the cylindrical axis of the head and set for cutting a plane canted with respect to the cylindrical axis. Laterally confronting side faces of the teeth provide pressure points for dislodging soil during use.

Other objects, features and advantages will be readily apparent from the following detailed description of the preferred embodiment taken in conjunction with the appended claims and accompanying drawings.

DESCRIPTION OF THE PREFERRED EMBODIMENT

Figure 1:
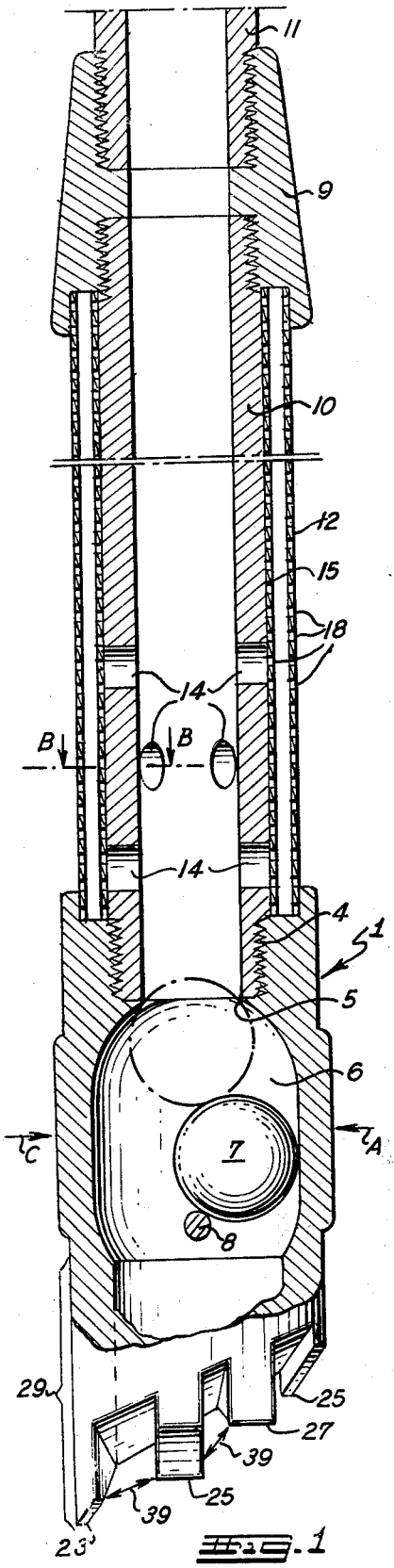
FIG. 1 is a side view, partly in section of the wellpoint of the present invention.
Figure 6:
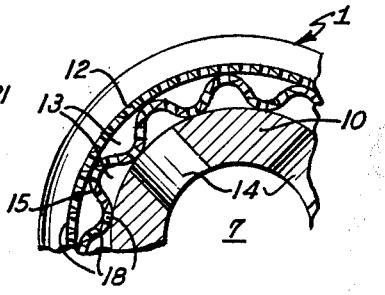
FIG. 6 is a section (enlarged) view along line B—B of FIG. 1 partly broken away.
Figure 2:
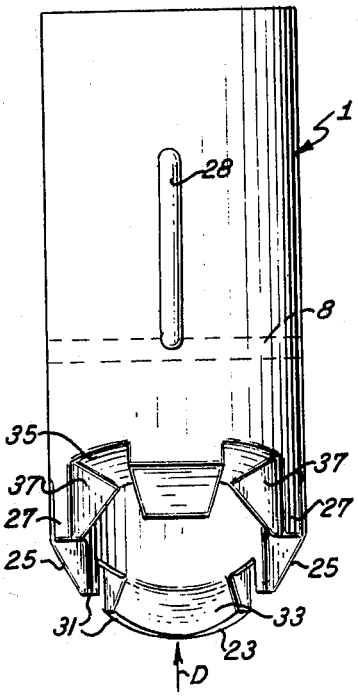
FIGS. 2 and 3 show elevational side views of the jetting head of the wellpoint in the direction of arrow A and C, respectively, of FIG. 1.
Figure 3:
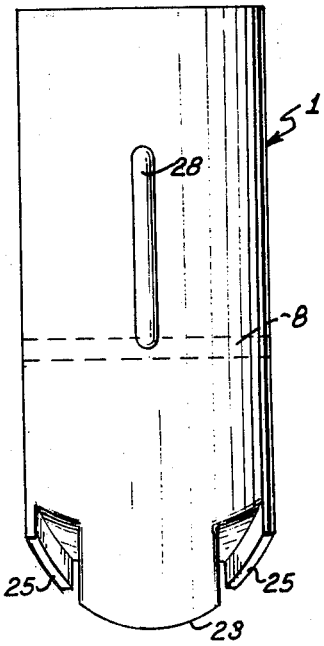

For a complete description of FIGS. 1 and 6 of the present invention, reference is made to U.S. Pat. No. 2,028,447, issued to T. G. Griffin on Jan. 21, 1936, and assigned to the assignee of the present invention. The present invention relates to an improvement over the Griffin patent, specifically in the area of the lower head of the wellpoint designated by the numeral 1 in our FIG. 1, which includes a valve seat 5, and a valve chamber 6 below the same and wherein works a ball valve 7, adapted to engage seat 5.

Particular attention is directed to the aforementioned Griffin patent to FIGS. 1 and 6 and to the specification beginning at column 1, line 47 and ending at column 2, line 26 inclusive, which are incorporated herein by reference and made a part hereof as if fully set forth herein.

The lower head or jetting nozzle 1 is adapted for both jet driving and hammer driving, and has a suitable retainer pin 8 against which the ball valve 7 will rest during a jetting operation. The nozzle has an upper threaded bore 4 for connecting the jetting head to the pipe 10, and such threads may be made to conform with existing wellpoint structures.

The jetting head 1 terminates at its forward end in an axially-thick cylindrical sleeve portion 29 having a plurality of spade-like teeth 23, 25, 27 formed from spatially communicating faces cut from the sleeve. The teeth extend forward to chisel-like tips 31 defining a perimetrical cutting plane canted with respect to the longitudinal axis of the sleeve.

Figure 5:
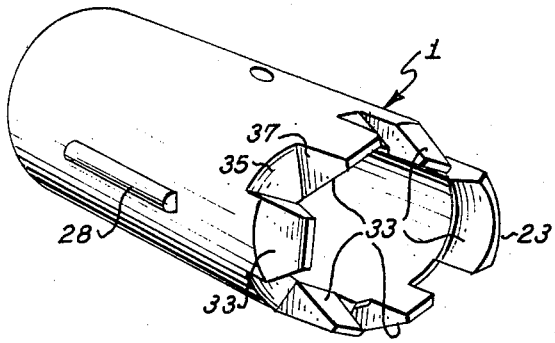
FIG. 5 is a perspective of the jetting head of the wellpoint of FIG. 1.
Figure 4:
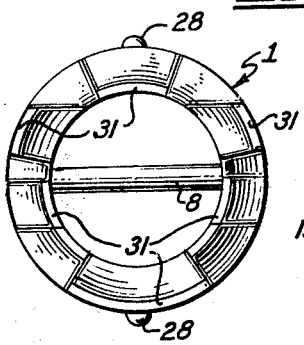
FIG. 4 shows an end view of the jetting head in the direction of arrow D of FIG. 2.

The teeth are offset in a counterbalancing arrangement, alternately sloping in an inward-outward mode about the head, as may best be seen in FIG. 5. Slightly arcuate bevels 33 form the slopes of the teeth with each bevel beginning either at the interior or exterior of the sleeve and sloping forward toward the opposite cylindrical surface, but stopping short of intersection therewith to form the chisel tip 31. As seen in FIG. 4, the chisel tips 31 are bullnosed or flat forming a portion of an arcuate segment concentric with the cylindrical axis of the sleeve and alternating in a radially-spaced relationship therefrom.

The preferred embodiment includes a special spade 23 and five other teeth designated by the numerals 25 and 27. The special spade 23 is larger than the other teeth and set to extend farthest forward on the head providing an initial cutting surface during an up-and-down chopping of the wellpoint.

The teeth are circumferentially-spaced about the head to provide a vacant pocket or channel 39 between adjacent teeth. The pockets 39 are formed by an inclined groove plane 35 originating from the interior of the sleeve and sloping in a direction opposite the teeth to merge with the outer cylindrical surface of the head. The pockets make the teeth more pronounced, exhibiting greater surface area of the laterally bounding sides of the teeth. The lateral sides of the teeth define pressure faces 37 for dislodging soil particulate during a rotational manipulation of the wellpoint and are positioned to confront the rotational path taken by the teeth during such a manipulation of the device.

In operation, the spade-like configuration of the special spade and offset teeth penetrate tough or hard subsoils preventing the wellpoint from being retarded during sinking, especially when using an up-and-down chopping and driving manipulation of the device. The staggered beveling of the teeth permits the pressure faces 37 to be exposed to the soil, and thus, while jetting with water under pressure as the wellpoint is sunk and moved by tilting, rotation or a combination thereof, the pressure faces 37 create pressure on gravel or stony elements in the soil, dislodging and moving such particulate aside.

The jetting head is provided with two or more ridges 28 extending longitudinally along the head and parallel to the rotational axis thereof. The ridges 28 are adapted to loosen the soil and make a hole larger than the diameter of the head during rotation of the wellpoint for facilitating insertion and extraction thereof from the soil.

It should be understood, of course, that the foregoing disclosure relates to a preferred embodiment of the invention and that other modifications or alterations may be made therein without departing from the spirit or scope of the invention as set forth in the appended claims.

What is claimed is:

1. A jetting nozzle head for use in a wellpoint device having a fluid delivery means to jet soil immediately in advance of said nozzle head, comprising:

means defining a nozzle adapted to be secured to the lower end of a wellpoint for receiving a passage of fluid under pressure therefrom;

a plurality of spade-like teeth annularly positioned at the forward end of said nozzle means and projecting longitudinally therefrom, said teeth terminating in a cutting surface defining a cutting plane canted with respect to the longitudinal axis of said nozzle means; and pressure face means formed on said teeth for dislodging soil particulate during a rotational manipulation of the wellpoint, said pressure face means disposed to confront a tilting, side-to-side, and up-or-down rotational path of said teeth during said manipulation.

2. A jetting nozzle head according to claim 1 wherein said teeth are circumferentially spaced, being beveled in an inward-outward staggered arrangement with respect to the longitudinal axis of said nozzle means; and said pressure face means positioned to cooperate with said beveled arrangement for exposing soil to said pressure face means during said rotational manipulation.

3. A jetting nozzle according to claim 2 and including pocket means formed between said teeth and cooperating with said pressure face means for exposing soil thereagainst during said rotational manipulation of the wellpoint.

4. A jetting nozzle according to claim 1 wherein one of said plurality of teeth is larger than other of said teeth, and set to extend farthest forward on said head.

5. A jetting nozzle head for use in a wellpoint device having a fluid delivery means to jet soil immediately in advance of said nozzle head, comprising:

means defining a nozzle adapted to be secured to the forward end of a wellpoint for receiving a passage of fluid under pressure therefrom, said nozzle means terminating at its forward end in an axially-thick cylindrical portion;

a plurality of spade-like teeth formed directly from said axially-thick portion, projecting longitudinally from said head and ending in a cutting surface defining a cutting plane canted with respect to the longitudinal axis of said nozzle means, said teeth annularly positioned in a circumferentially-spaced relationship and beveled in an offsetting inward-outward arrangement around the head, said teeth having lateral confronting side faces forming points of pressure for dislodging soil particulate during a rotational manipulation of the wellpoint.

* * * * *